United States Patent [19]

Silverstein

[11] Patent Number: 4,761,882

[45] Date of Patent: Aug. 9, 1988

[54] UTILITY KNIFE

[75] Inventor: Sidney Silverstein, Flushing, N.Y.

[73] Assignee: Hunt X-Acto, Inc., Philadelphia, Pa.

[21] Appl. No.: 830,326

[22] Filed: Feb. 18, 1986

[51] Int. Cl.[4] ..... B26B 1/08

[52] U.S. Cl. ..... 30/162; 30/40.2; 30/125; 30/335

[58] Field of Search ..... 30/162, 335, 125, 40.2

[56] References Cited

U.S. PATENT DOCUMENTS

| | | | |
|---|---|---|---|
| 2,776,743 | 1/1957 | Treiss | 30/40.2 X |
| 3,316,635 | 5/1967 | Merrow | 30/162 |
| 3,577,637 | 5/1971 | Braginetz | 30/162 |
| 3,708,881 | 1/1973 | Bennett | 30/335 X |
| 3,879,847 | 4/1975 | Roll | 30/162 |
| 4,586,256 | 5/1986 | Weimann | 30/162 |

*Primary Examiner*—Douglas D. Watts

*Attorney, Agent, or Firm*—Alexis Barron; Albert L. Free

[57] ABSTRACT

A retractable utility knife comprises a handle having a front portion and a rear portion, a blade carrier slideably mounted in a passageway in the front portion of the handle for positioning a blade in retracted-protected, exposed-cutting, or advanced attachment-detachment positions, with the passageway extending to the front portion of the handle a sufficient distance to position a forward mounting lance of the blade carrier outside the handle to free the blade for detachment from the mounting lance by grasping the front portion of the blade and lifting it off the carrier. A blade magazine for replacement blades is provided in the rear portion of the handle and has a top wall with a finger opening smaller than a blade, a spring-biased pusher member mounted in the blade magazine to push the replacement blades toward the top wall so that the top blade is flush against the top wall, a transverse slot extending downwardly from the top wall for sliding a replacement blade into or out of the magazine and guard apparatus positioned in the rearward path of the top blade in the magazine for preventing accidental removal of the top blade from the magazine.

3 Claims, 2 Drawing Sheets

UTILITY KNIFE

BACKGROUND OF THE INVENTION

1. Field of the Invention

This invention relates to utility knives and, more particularly, concerns knives having a readily changeable and retractable blade.

2. Description of the Prior Art

Utility knives are known in the art. One such knife is disclosed in U.S. Pat. No. 4,227,306 in which a detachable blade is mounted between two handle halves or shells that form a handle and that are secured together by a screw. A disadvantage of this knife is that it is inconvenient and time consuming for a user to replace a used blade with a fresh blade since the handle halves must first be separated by detaching the screw. Another disadvantage of this knife is that the blade is not retractable leaving the blade exposed when the knife is not in use.

Utility knives having a retractable blade that is replaceable without taking the handle apart are also known in the art. For instance, U.S. Pat. No. 3,660,896 discloses a utility knife having a retractable blade that is carried by a blade carrier from a storage chamber, housing replacement blades, to an operable cutting position, and that is released from the handle by first moving the blade carrier laterally to disengage it from the blade and by then sliding the blade from the opening at the end of the handle. Knives of this type also are known that have magnetic loading means or adhesive loading means for securing a blade housed in the blade magazine to the blade carrier. However, these knives have the disadvantage of being complicated in their structure and operation.

Another utility knife is disclosed in U.S. Pat. No. 3,577,637 having a retractable blade that is replaceable without disassembling the handle. However, substituting a fresh blade for a used blade requires manipulating the blade carrier laterally to disengage the blade, sliding the blade from the opening at the front end of the handle and sliding a fresh blade into the opening. This utility knife has separate storage means for holding replacement blades.

SUMMARY OF THE INVENTION

It is an object of the invention to provide a utility knife having a quick-change retractable blade that may be replaced easily and quickly without disassembling the knife handle, and having an easy access blade storage area.

It is another object of the invention to provide a utility knife having a blade that may be selectively positioned in various cutting positions, and, when the knife is not in use, positioned in a fully retracted position to prevent accidents and injury due to contact with an exposed blade.

Another object of the invention is to provide a utility knife having in its handle a blade magazine for replacement blades to which replacement blades may be added easily and safely and from which replacement blades may be removed easily and safely.

Another object of the invention is to provide a utility knife having a blade magazine for replacement blades that has safety features that limit the chances of a replacement blade accidentally dislodging from the blade magazine and that limit the removal or addition of replacement blades to one blade at a time.

These objects are accomplished by providing a knife that comprises a handle having a front portion and a rear portion, a detachable blade, and a blade carrier slideably mounted in a passageway in the front portion of the handle for positioning the blade in retracted-protected, exposed-cutting, or advanced attachment-detachment positions. The blade carrier is provided with locking means for locking the blade to the blade carrier when the blade is in a cutting position or in retracted position, and the blade carrier is moveable to an advanced position where the blade carrier projects from the handle to such an extent that it frees the blade from the carrier without disassembling the knife handle. The knife is provided with a blade magazine for storing replacement blades, and is also provided with a guard at the entrance-exit opening to the blade magazine that blocks the accidental removal of a replacement blade from the blade magazine and that limits the removal of replacement blades from the blade magazine, or the addition of replacement blades to the blade magazine, to one blade at a time.

DETAILED DESCRIPTION

Turning now to the drawings, there is shown a knife 11 that comprises a detachable blade 13 that is retractably mounted in a handle 15.

Figure 3:
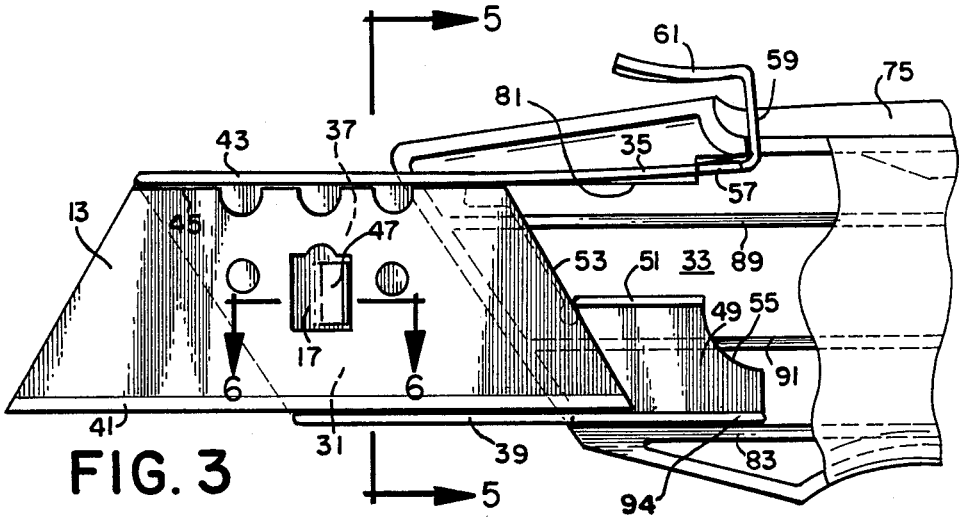
FIG. 3 is a partial view in section of the knife with the blade carrier in attachment-detachment position and shows the blade carrier and blade projecting from the knife handle.
Figure 6:
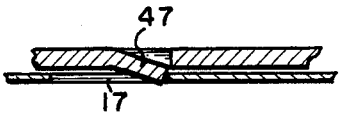
FIG. 6 is an enlarged view in section taken as indicated by the lines and arrows 6—6 of FIG. 3.
Figure 4:
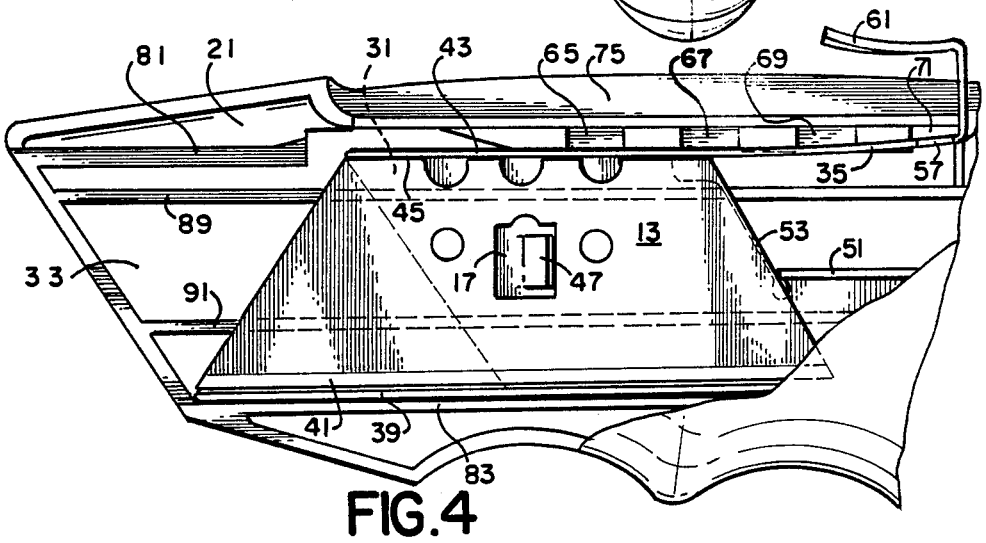
FIG. 4 is a partial view in section of the knife with the blade being fully retracted.

Detachable blade 13, as shown in FIGS. 3 and 4, is trapezoidal in shape and is provided with a rectangular cutaway portion 17 at its center, three notches at its top edge and a circular cutout on each side of cutout portion 17.

Handle 15 includes a pair of shells 19, 21 held together by a rivet 23 that extends through shells 19 and 21 with the ends of the rivet being seated in recesses in the outer surface of the shells. To keep shells 19, 21 in alignment, shell 21 is provided with two inwardly extending stems, one at each end, that are aligned with a pair of complementary stem receiving bores in shell 19 that receive the stems.

Handle 15 has a front portion 25 that houses the blade 13 in cutting and retracted positions, and a rear portion 27 that houses a blade magazine 29 for replaceable blades.

A blade carrier 31 is slideably mounted in a passageway 33 in front portion 25 of handle 15 in retracted-protected, exposed-operating, or advanced attachment-detachment positions, and, as shown in FIG. 3, includes a spring finger 35 that extends from a plate 37 which holds the blade 13.

Plate 37 is provided with a lower flange 39 adapted to engage cutting edge 41 of blade 13 and an upper flange 43 adapted to engage the top edge 45 of blade 13 so that the blade is mounted between the flanges 43, 45. Plate 37 also is provided with a lug or lance 47 that extends away from the plate 37 and is adapted to engage cutaway portion 17 of blade 13 to prevent the blade 13 from moving in a forward direction. An extension plate section 49 extends rearwardly from plate 37 and has an upper flange 51 adapted to engage rear edge 53 of blade 13 and prevent blade 13 from moving rearwardly.

A spring finger 35 extends rearwardly from upper flange 43 and is provided with a pair of outwardly extending latching lugs 57, and is connected by member 59 to a thumb tab 61.

Handle 15 has a slot 63 formed at its top through which member 59 extends and along which member 59 may be moved. Below slot 63, each shell 19, 21 is provided with a series of downwardly extending notches 65, 67, 69 and 71 into which latching lugs 57 of outwardly biased spring finger 35 are adapted to engage to hold the blade 13 in cutting and retracted positions, respectively. Recessed shoulder 73 in shell 19 and recessed shoulder 75 in shell 21 are provided at the edges of slot 63 to form a recess into which tab 61 may be depressed to release latching lugs 57 from notches 65, 67, 69 or 71. Connecting member 59 is almost as wide as slot 63 to prevent undesired lateral movement of the carrier 31 and blade 13.

Figure 7:
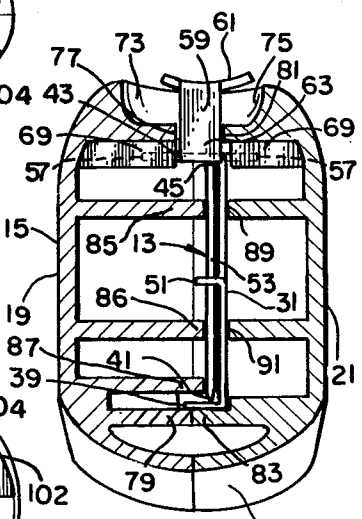
FIG. 7 is a view in cross-section taken as indicated by the lines and arrows 7—7 of FIG. 2.
Figure 5:
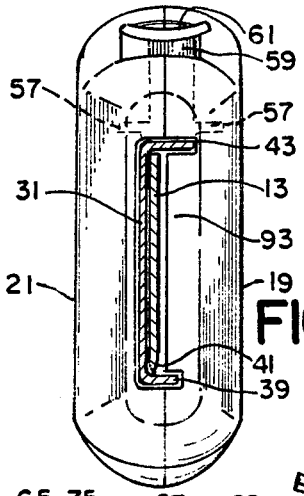
FIG. 5 is an end view taken as indicated by the lines and arrows 5—5 of FIG. 3.

To insure that blade 13 is held firmly in place on the carrier 31, and the blade 13 and carrier 31 are held properly in place in passageway 33, the interiors of shells 19 and 21 are provided with guide ribs that cooperate to hold the blade 13 and carrier 31 firmly in place. As is shown in FIG. 7, ribs 77 and 79 of shell 19 cooperate with ribs 81 and 83 of shell 21 to provide upper and lower guides in passageway 33 for flanges 39 and 43 of blade carrier 31 which ride between them. Ribs 85, 86 and 87 of shell 19 and ribs 89 and 91 of shell 21 cooperate to limit lateral movement of blade carrier 31 and blade 13. Further, as seen in FIG. 5, shell 19 is provided with a flange 93 which defines a C-shaped opening in handle front portion 25 to limit movement of blade carrier 31 and blade 13 when in cutting position.

Lower flange 39 of blade carrier 31 is provided with an extended rear portion 94 that wedges against the interior of shell 19 when blade carrier 31 is in the advanced attachment - detachment position to stabilize blade carrier 31 as it protrudes from handle 15. Further, upper flange 43 is wider where it joins spring finger 35, and wedges against the interior of shell 19 at this point when blade carrier 31 is in the advanced attachment - detachment position.

Figure 1:
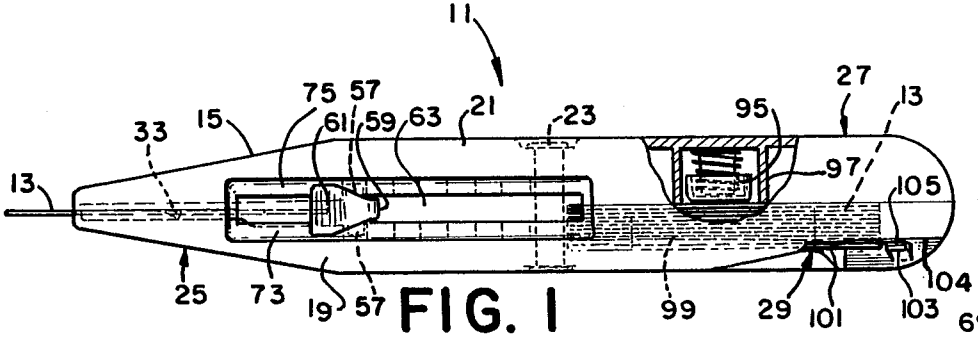
FIG. 1 is a top plan view of a utility knife having a blade magazine with the blade magazine shown in section.
Figure 2:
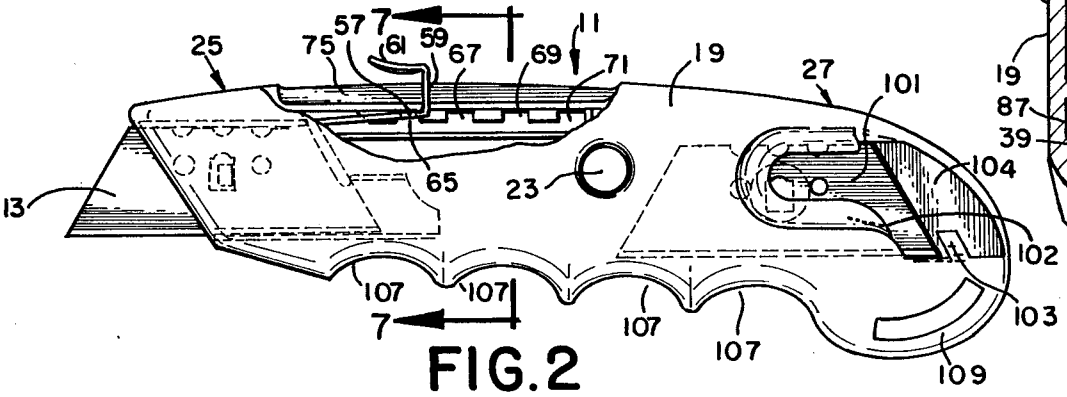
FIG. 2 is a view in elevation of the knife of FIG. 1 with a portion of the knife interior being shown in section.

Blade magazine 29, as seen in FIGS. 1 and 2, is formed in the rear portion 27 of handle 15 and includes a spring-biased pusher member 95, mounted in a circular well 97 formed inside shell 21, that pushes a stack of replacement blades against top wall 99 of blade magazine 29 so that the top blade is flush against top wall 99. Top wall 99 of blade magazine 29 is provided with a finger opening 101, which is smaller than a blade, for sliding a blade 13 through a transverse slot 102 for the removal or addition of blades 13.

A guard lug 103 is provided next to slot 102 and projects upwardly from the surface of the handle in the path of a replacement blade 13 being slid from the magazine 29 in the plane of the top blade 13 when it is flush against the top wall 99. Guard lug 103 forms a channel 105 between itself and an outside flat surface 104 of shell 19, and channel 105 is slightly wider than the width of one blade 13 to permit passage of a blade 13 into or out of magazine 29. Guard 103 blocks the removal of a blade 13 from blade magazine 29 unless the blade 13 is depressed slightly to below the level of guard 103 into alignment with channel 105 to permit the blade to slide through channel 105 and be released from blade magazine 29.

Blades 13 may be added to blade magazine 29 by depressing the top blade stored in blade magazine 29, or, in the case of the blade magazine being empty, depressing the pusher member 95, below the level of channel 105 and then sliding blade 13 under guard 103 and through channel 105 and transverse slot 102 into blade magazine 29.

Handle 15 is provided with finger notches 107 to facilitate gripping, and a loop 109 is provided to permit hanging of knife 11 on a nail or a user's belt clip when not in use.

In operation, blade 13 may be removed from handle 15 and replaced or reversed without disassembling handle 15 by depressing tab 61, thereby releasing latching lugs 57 from engagement with any of notches 65, 67, 69, and 71, and then sliding tab 61 forwardly to the front end of slot 63, as shown in FIG. 3, so that blade carrier 31, blade 13, and lance 47 protrude from handle 15 to free blade 13 which may be grasped by the fingers and removed from blade carrier 31. Another blade 13 may then be placed onto blade carrier 31, and blade carrier 31 with the new blade 13 may be slid back into passageway 33 by exerting pressure on tab 61.

As shown in FIG. 2, locking lugs 57 are engaged in notch 65 to position blade 13 in a fully exposed or advanced cutting position. Tab 61 may be depressed and blade carrier 31 selectively moved rearwardly into partly exposed cutting positions of notches 67, 69, and the retracted position of notch 71.

In summary, retractable utility knife 11 comprises a handle 15 having a front portion 25 and a rear portion 27, with a blade carrier 31 slideably mounted in a passageway 33 in the front portion 25 of the handle 15 for positioning a blade 13 in retracted-protected, exposed-cutting, or advanced attachment-detachment positions. A tab 61 extends from the blade carrier 31 for moving the blade carrier 31 back and forth in the passageway 33, and guide ribs 77, 79, 81, 83, 85, 86, 87, 89, 91 are positioned in handle 15 on each side of passageway 33 to define passageway 33 and hold the blade 13 and carrier 31 in position to prevent lateral movement.

Carrier 31 has top, bottom and rear mounting flanges 43, 39, 51, and a forward mounting lance 47, adapted to register with central cutaway portion 17 on the blade 13 for holding the blade in position against longitudinal movement on the carrier 31.

Passageway 33 extends to the front portion 25 of the handle 15 a sufficient distance to position the forward mounting lance 47 outside the handle 15 to free the blade 13 for detachment from the carrier 31 by grasping the front portion of the blade 13 and lifting it off the carrier 31. The handle 15 comprises a first half-handle shell 19 secured to a second half-handle shell 21.

The actuating means for moving the carrier 31 includes a spring finger 35 which has latching lugs 57 adapted to engage notches 65, 67, 69, 71 inside the handle 15 to lock the blade 13 in retracted-protected and exposedcutting positions.

Storage means are provided in the rear portion 27 of the handle 15 for storing replacement blades, and comprises a blade magazine 29 in the rear portion 27 of the handle 15 which has a top wall 99 with a finger opening 101 smaller than a blade 13. A spring-biased pusher member 95 is mounted in the blade magazine 29 to push the replacement blades toward the top wall 99 so that the top blade is flush against the top wall 99. A transverse slot 102 extends downwardly from the top wall 99 for sliding a replacement blade 13 into or out of the magazine 29, and a guard lug 103 is positioned in the rearward path of the top blade 13 in the magazine 29 for preventing accidental removal of the top blade from the magazine 29. Stop lug 103 projects upwardly from the surface of the handle 15 in the path of a replacement blade when it is being slid from the magazine 29 in the plane of the top blade in the magazine 29 flush against the top wall 99 of the magazine. A channel 105 is formed between the stop lug 103 and a flattened surface 104 of the handle 15, with the channel 105 being positioned below the plane of the top blade flush against the top wall 99 of the magazine 29.

Blades 13 may be removed from the magazine 29 by pressing downwardly through the finger opening 101 to position the top blade in the plane of the channel 105 and sliding the blade 13 through the transverse slot 102 and channel 105, and blades may be added to the magazine 29 by pressing downwardly through the finger opening 101 to depress the top blade or by pushing member 95 downwardly below the plane of the channel 105 and sliding a replacement blade through the channel 105 and transverse slot 102 into the magazine 29.

I claim:

1. A retractable utility knife comprising a handle having a front portion and a rear portion, a blade carrier slideably mounted in a passageway in the front portion of the handle for positioning a blade in retracted-protected, exposed-cutting, or advanced attachment-detachment positions, actuating means extending from the blade carrier for moving the blade carrier back and forth in the passageway, and rib means positioned in the handle on each side of the passageway to define the passageway and hold the blade and carrier in position to prevent lateral movement, said carrier having top, bottom and rear mounting flanges, and a forward mounting lance adapted to register with a central cutaway portion on the blade for holding the blade in position against longitudinal movement on the carrier, said passageway extending to the front portion of the handle a sufficient distance to position the forward mounting lance outside the handle to free the blade for detachment from the mounting means by grasping the front portion of the blade and lifting it off the carriage, further including storage means in the rear portion of the handle for storing replacement blades, the storage means including a blade magazine in the rear portion of the handle having a top wall with a finger opening smaller than a blade, a spring-biased pusher means mounted in the blade magazine to push the replacement blades toward the top wall so that the top blade is flush against the top wall, a transverse slot extending downwardly from the top wall for sliding a replacement blade into or out of the magazine, and guard means positioned in the rearward path of the top blade in the magazine for preventing accidental removal of the top blade from the magazine.

2. The knife of claim 1 means includes a stop lug projecting upwardly from the surface of the handle in the path of a replacement blade being slid from the magazine in the plane of the top blade in the magazine when it is flush against the top wall of the magazine, and a channel formed between the stop lug and a flattened surface of the handle, with the channel being positioned below the plane of the top blade flush against the top wall of the magazine, whereby blades may be removed from the magazine by pressing downwardly through the finger opening to position the top blade in the plane of the channel and sliding the blade through the transverse slot and channel, and whereby blades may be added to the magazine by pressing downwardly through the finger opening to depress the top blade or pushing means downwardly below the plane of the channel and sliding a replacement blade through the channel and transverse slot into the magazine.

3. A retractable utility knife comprising a handle having a front portion and a rear portion, a blade carrier slideably mounted in a passageway in the front portion of the handle for positioning a blade in retracted-protected, exposed-cutting, or advanced attachment-detachment positions, actuating means extending from the blade carrier for moving the blade carrier back and forth in the passageway, rib means positioned in the handle on each side of the passageway to define the passageway and hold the blade and carrier in position to prevent lateral movement, said carrier having top, bottom and rear mounting flanges, and a forward mounting lance adapted to register with a central cutaway portion on the blade for holding the blade in position against longitudinal movement on the carrier, said passageway extending to the front portion of the handle a sufficient distance to position the forward mounting lance outside the handle to free the blade for detachment from the mounting means by grasping the front portion of the blade and lifting it off the carrier, the handle comprising a first half-handle shell secured to a second half-handle shell, the actuating means including a spring finger having latching lugs adapted to engage notches inside the handle to lock the blade in retracted-protected, exposedcutting, or advanced attachment-detachment positions, storage means in the rear portion of the handle for storing replacement blades, the storage means including a blade magazine in the rear portion of the handle having a top wall with a finger opening smaller than a blade, a spring-biased pusher means mounted in the blade magazine to push the replacement blades toward the top wall so that the top blade is flush against the top wall, a transverse slot extending downwardly from the top wall for sliding a replacement blade into or out of the magazine, guard means positioned in the rearward path of the to blade in the magazine for preventing accidental removal of the top blade from the magazine, the guard means including a stop lug projecting upwardly from the surface of the handle in the path of a replacement blade being slid from the magazine in the plane of the top blade in the magazine when it is flush against the top wall of the magazine, a channel formed between the stop lug and a flattened surface of the handle, with the channel being positioned below the plane of the top blade flush against the top wall of the magazine, whereby blades may be removed from the magazine by pressing downwardly through the finger opening to position the top blade in the plane of the channel and sliding the blade through the transverse slot and channel, and whereby blades may be added to the magazine by pressing downwardly through the finger opening to depress the top blade or pushing means downwardly below the plane of the channel and sliding a replacement blade through the channel and transverse slot into the magazine.

* * * * *